US006121596A

United States Patent [19]

Taino et al.

[11] Patent Number: 6,121,596

[45] Date of Patent: Sep. 19, 2000

[54] COOKING APPLIANCE THAN CAN DETECT TEMPERATURE OF FOODSTUFF USING INFRARED SENSOR

[75] Inventors: Kazuo Taino, Kouga-gun; Masaru Noda, Hikone; Kazuko Tanaka, Yasu-gun; Chizuko Konishi, Ohmihachiman, all of Japan

[73] Assignee: Sanyo Electric Co., Ltd., Moriguchi, Japan

[21] Appl. No.: 09/320,267

[22] Filed: May 27, 1999

[30] Foreign Application Priority Data

May 29, 1998 [JP] Japan ..... 10-149274
May 29, 1998 [JP] Japan ..... 10-149462

[51] Int. Cl.[7] ..... H05B 6/68

[52] U.S. Cl. ..... 219/711; 219/710; 219/754; 219/494; 99/325; 374/149

[58] Field of Search ..... 219/711, 710, 219/494, 754; 99/325; 374/149, 121

[56] References Cited

U.S. PATENT DOCUMENTS

| | | | |
|---|---|---|---|
| 4,506,127 | 3/1985 | Satoh | 219/710 |
| 5,702,626 | 12/1997 | Kim | 219/711 |
| 5,796,081 | 8/1998 | Carlsson et al. | 219/711 |

FOREIGN PATENT DOCUMENTS

| | | |
|---|---|---|
| 2 301 006 | 11/1996 | United Kingdom . |
| 2 314 173 | 12/1997 | United Kingdom . |
| 2 324 889 | 11/1998 | United Kingdom . |

*Primary Examiner*—Philip H. Leung
*Attorney, Agent, or Firm*—Armstrong, Westerman, Hattori, McLeland & Naughton

[57] ABSTRACT

In a cooking appliance, the foodstuff is placed on a turntable in a heating chamber. Infrared radiation emitted from the foodstuff is sensed by an infrared sense unit. The cooking appliance obtains the number of extrema of the amount of infrared radiation sensed over the period of one cycle of the turntable. The number of foodstuffs is determined according to the number of maxima. A control unit drives a heat unit according to the determined number of foodstuffs.

9 Claims, 15 Drawing Sheets

COOKING APPLIANCE THAN CAN DETECT TEMPERATURE OF FOODSTUFF USING INFRARED SENSOR

BACKGROUND OF THE INVENTION

1. Field of the Invention

The present invention relates to cooking appliances, and particularly to a cooking appliance that detects the temperature of a foodstuff placed on a turntable using an infrared sensor.

2. Description of the Background Art

A microwave oven including an infrared sensor can be referred to as a first conventional example of a cooking appliance. In such a microwave oven, the foodstuff is placed on a rotating turntable. An infrared sensor senses the infrared radiation emitted from that foodstuff in the sense field thereof (the range where the infrared sensor can sense infrared radiation). The temperature of that foodstuff is detected according to the amount of sensed infrared radiation. Heating of the foodstuff is continued until the temperature of the foodstuff arrives at a predetermined consummation temperature of the foodstuff.

Arrangement of the foodstuff on the turntable varies corresponding to the number of foodstuff placed on the turntable in such a microwave oven. This means that the portion of the foodstuff within the sense field of the infrared sensor differs. If the portion of the foodstuff within the sense field of the infrared sensor differs, the detected temperature of the foodstuff corresponding to the sensed infrared radiation may change.

For example, consider the case where a bottle containing liquor, curved in shape and with height, is to be heated as the foodstuff.

When there is only one foodstuff such as one bottle, the arrangement of the bottle at the center of the turntable allows the portion of the bottle within the sense field of the infrared sensor to be always constant even when the turntable is rotated. Therefore, the temperature detected using an infrared sensor is identical when the temperature distribution of the bottle (foodstuff) is identical.

However, when there are a plurality of foodstuffs such as a plurality of bottles, the portion of each bottle that will be located within the sense field of the infrared sensor will vary according to the rotation of the turntable. More specifically, the section of the bottle within the sense field of the infrared sensor may be the neck portion of the bottle that exhibits rapid increase in temperature due to convection and the like or be the bottom portion of the bottle where the temperature increase is slow. There will be deviation in the detected temperature of the foodstuff.

When the number of the foodstuff increases in such a microwave oven, there is a case where the portion of the foodstuff of faster rise in temperature is located within the sense field of the infrared sensor than that of the infrared sensor for only one foodstuff due to the rotation of the turntable. There was a problem that the detected temperature of the foodstuff becomes ostensibly higher than the case where the number of foodstuff in the same state is only 1.

The operation of heating is stopped when the detected temperature of the foodstuff once arrives at the consummation temperature in the above-described microwave oven. Since there is an occasion where the detected temperature of the foodstuff when increased in number becomes higher momentarily than when only one in number, there was a problem that the actual consummated temperature becomes lower than the preset consummation temperature.

To solve such a problem, an approach can be considered of detecting the number of foodstuffs and applying correction according to the number of foodstuffs with respect to the detected temperature of foodstuff.

A microwave oven having the heating time determined according to a set cooking menu, absent of detection by an infrared sensor, can be referred to as a second conventional example of a cooking appliance. Such a microwave oven had the disadvantage that the foodstuff, when increased in number, is less easily heated to result in change in the actual consummated temperature of the foodstuff. In other words, the number of foodstuffs must be detected in that type of microwave oven, likewise the first conventional example.

A microwave oven including a weight sensor to detect the number of foodstuffs can be referred to as the third conventional example of a cooking appliance. The weight of the container of the food item will be included in the weight of the foodstuff when a weight sensor is employed. There is a case where the number of the foodstuffs cannot be detected properly depending upon the container that is used.

In the microwave oven of the first conventional example, the portion of the foodstuff located within the sense field of the infrared sensor will differ depending upon whether it is placed at the center or edge of the turntable even when the number of foodstuffs is identical.

For example, the portion of the foodstuff and the altitude (position in the height direction) of the foodstuff located within the sense field of the infrared sensor differ depending upon whether the foodstuff is located close to or remote from the infrared sensor. Because of heat convection, the portion of the foodstuff of higher altitude is generally higher in temperature than the portion of the foodstuff of lower altitude. Also, the detected temperature of a foodstuff becomes higher for a foodstuff having a larger proportion thereof in the sense field due to its close location to the infrared sensor than a foodstuff having a smaller proportion within the sense field such as in the case of being located remote from the infrared sensor, even when under the same condition.

In other words, the above first conventional example may have a different detected temperature of the foodstuff depending upon the location on the turntable, even when under the same condition. Thus, there was a problem that the actual consummated temperature differs depending upon the location of the foodstuff on the turntable even when the preset consummation temperature of the foodstuff is identical.

SUMMARY OF THE INVENTION

In view of the foregoing, an object of the present invention is to provide a cooking appliance that can realize a constant consummate temperature irrespective of the number of foodstuffs to be heated.

Another object of the present invention is to provide a cooking appliance that can realize a constant consummate temperature irrespective of the location of the foodstuff to be heated.

According to an aspect of the present invention, a cooking appliance includes a heating chamber to accommodate a foodstuff, a heat unit, a turntable on which a foodstuff is mounted, rotating at a predetermined cycle, an infrared sense unit sensing infrared radiation emitted from the foodstuff in the heating chamber, and a control unit determining the number of foodstuffs according to the number of exhibited extrema for the amount of infrared radiation sensed over a predetermined cycle and that drives the heat unit according to the determined number of foodstuffs.

According to the cooking appliance of the present invention, the control unit determines the number of foodstuffs on the turntable from the number of extrema for the amount of infrared radiation sensed by the infrared sense unit over a predetermined cycle. The heat unit is driven according to the determined number of foodstuffs by the control unit.

According to the cooking appliance, the number of foodstuffs can be detected independent of the weight of the container. Therefore, correction corresponding to the number of foodstuffs can be made for the detected temperature and heating time of the foodstuff. The consummation temperature of the foodstuff to be heated can be made uniform irrespective of the number of foodstuffs.

Preferably, the control unit determines a higher set temperature as the determined number of foodstuffs increases, determines the temperature of the foodstuff according to the amount of the sensed infrared radiation, and drives the heat unit to heat the foodstuff until the determined temperature of the foodstuff arrives at the set temperature.

Thus, the foodstuff is heated until the temperature of the foodstuff determined by the control unit becomes higher as the number of foodstuffs increases.

Thus, correction corresponding to the number of foodstuffs can be applied to the temperature of the foodstuff determined according to the infrared radiation sensed by the infrared sense unit.

Preferably, the control unit determines a longer set time for heating as the determined number of foodstuffs increases, and drives the heat unit so that the foodstuff is heated for only the set time.

Accordingly, heating is carried out for a longer period of time proportional to the number of foodstuffs.

Correction corresponding to the number of foodstuffs can be applied to the heating time.

According to another aspect of the present invention, a cooking appliance includes a heating chamber to accommodate a foodstuff, a heat unit, a turntable on which a foodstuff is placed and that rotates at a predetermined cycle, an infrared sense unit to sense infrared radiation emitted from the foodstuff in the heating chamber, and a control unit determining the mounted position of the foodstuff on the turntable depending upon whether there is an extremum in the amount of infrared radiation sensed over a predetermined cycle, and driving the heat unit according to the determined mounted position of the foodstuff.

According to the cooking appliance of the present invention, the location on the turntable where the foodstuff is placed is determined according to the infrared radiation sensed by the infrared sense unit. The heat unit is driven according to the determined placement of the foodstuff.

Correction corresponding to the placement of the foodstuff on the turntable can be made to the detected temperature or heating time of the foodstuff. Therefore, the consummation temperature of the foodstuff to be heated can be made constant irrespective of the mounted position of the foodstuff on the turntable.

Preferably, the control unit determines the mounted position of the foodstuff on the turntable according to the rate of change of the amount of infrared radiation in the vicinity of the extremum when the amount of infrared radiation exhibits an extremum.

Thus, the mounted position of the foodstuff on the turntable can be detected more correctly.

Preferably, the control unit determines that the foodstuff is placed at the center of the turntable when the rate of change of the amount of the infrared radiation in the vicinity of the extremum is equal to or below a predetermined value.

Accordingly, the foodstuff is assumed to be mounted at the center when the foodstuff is located substantially at the center of the turntable and considered to be of no concern even when taken as placed at the center.

Therefore, the heating control can be made more simple in the cooking appliance.

Preferably, the control unit determines a different set temperature depending upon the distance between the determined mounted position of the foodstuff and the center of the turntable, determines the temperature of the foodstuff according to the sensed infrared radiation, and drives the heat unit so as to heat the foodstuff until the determined temperature of the foodstuff arrives at the set temperature.

Accordingly, correction according to the mounted position of the foodstuff on the turntable can be applied to the temperature of the foodstuff determined from the infrared radiation sensed by the infrared sense unit.

Preferably, the control unit determines a different set time according to the distance between the determined mounted position of the foodstuff and the center of the turntable, and drives the heat unit to heat the foodstuff for the set time.

Accordingly, correction corresponding to the mounted position of the foodstuff on the turntable can be applied to the heating time.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
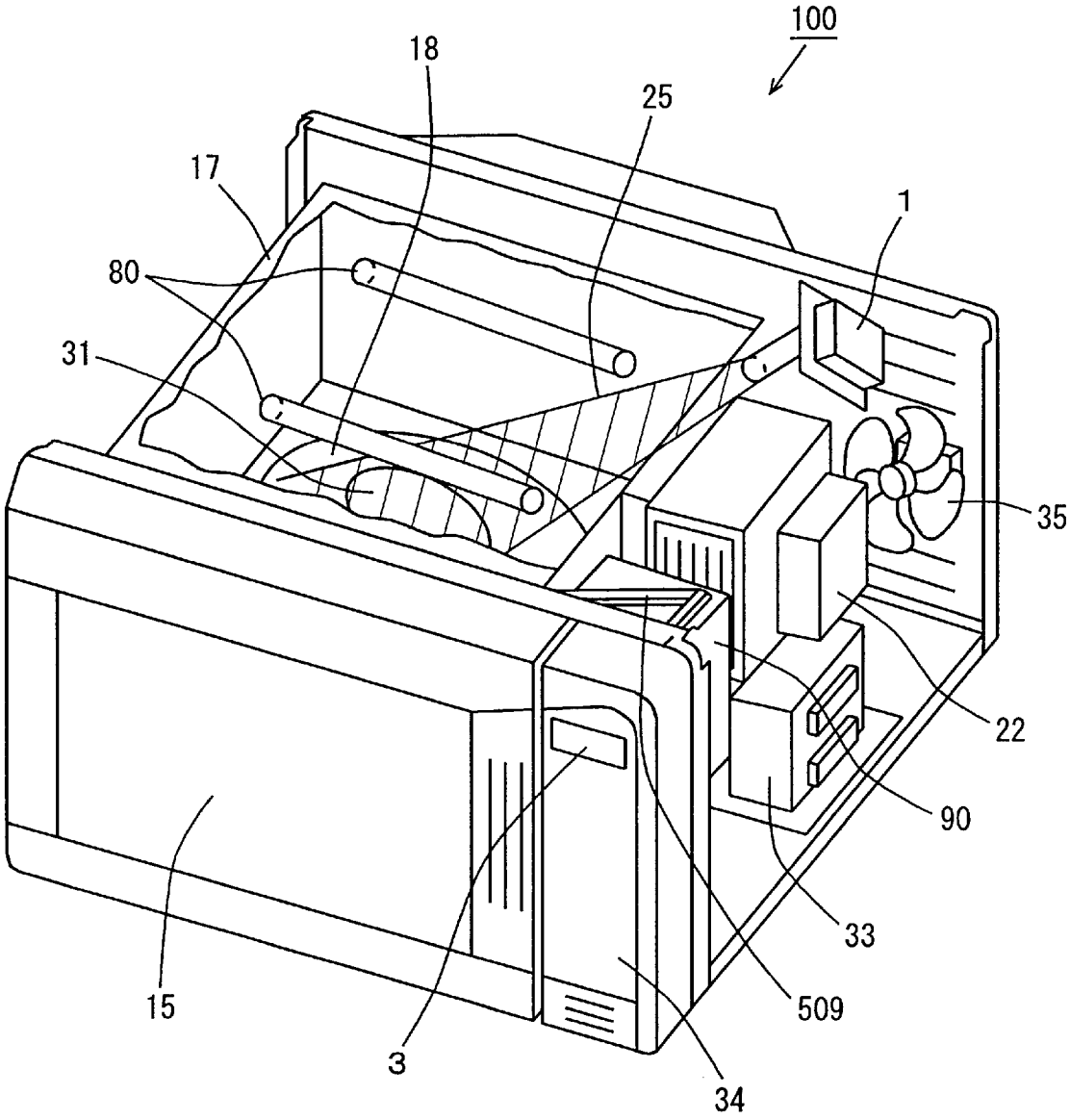
FIG. 1 is a perspective view of a microwave oven according to an embodiment of the present invention.

An embodiment of the present invention will be described hereinafter with reference to the drawings. In the drawings, the same or likewise components have the same reference characters allotted.

FIG. 1 is a perspective view of a microwave oven 100 according to an embodiment of the present invention in FIG. 1 with the housing unit thereof and the top plane of a heating chamber 17 omitted for the purpose of describing the inner structure of microwave oven 100.

Figure 2:
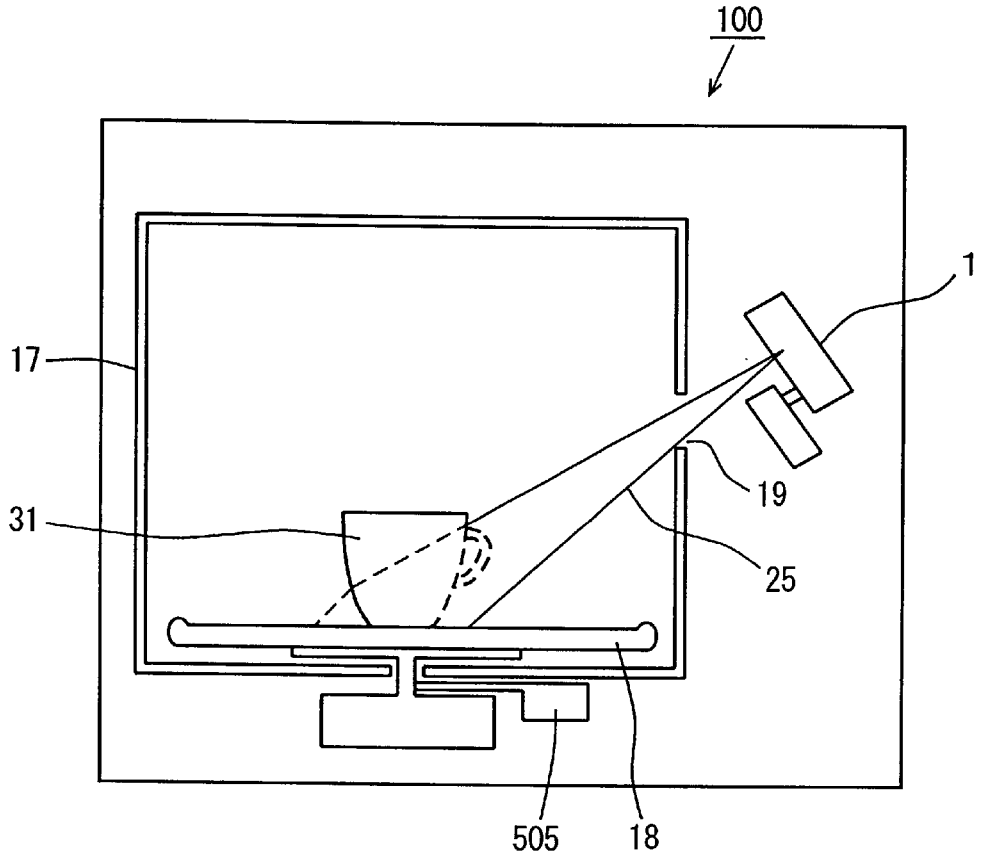
FIG. 2 is a simplified sectional view of the inside structure of the microwave oven of FIG. 1.

Referring to FIGS. 1 and 2, microwave oven 100 includes an infrared sensor 1 at the side of heating chamber 17. Infrared sensor 1 is arranged to capture infrared radiation 25 emitted from foodstuff 31 via a sense hole 19 from above in an oblique manner.

A magnetron 22 supplies a microwave into heating chamber 17. A high voltage transformer 33 is arranged below magnetron 22 to supply high voltage thereto. A heater 80 to heat foodstuff 31 is arranged at the upper portion of heating chamber 17. A fan 35 is provided to cool magnetron 22 and heater 80, or the peripheral device (including infrared sensor 1) raised in temperature by the heat of heating chamber 17.

A door 15 is attached at the front side of heating chamber 17. An operation panel 34 for the user to set the cooking menu is provided at the side of door 15. A control unit 90 to provide the overall control of each component of microwave oven 100 is provided at the back of operation panel 34. Control unit 90 includes a microcomputer. Operation panel 34 includes a display unit 3 to display information and the like input by the user.

A turntable 18 on which foodstuff 31 is to be placed is provided at the bottom of heating chamber 17. A turntable motor 505 to rotate turntable 18 is provided beneath the bottom of heating chamber 17.

Figure 3:
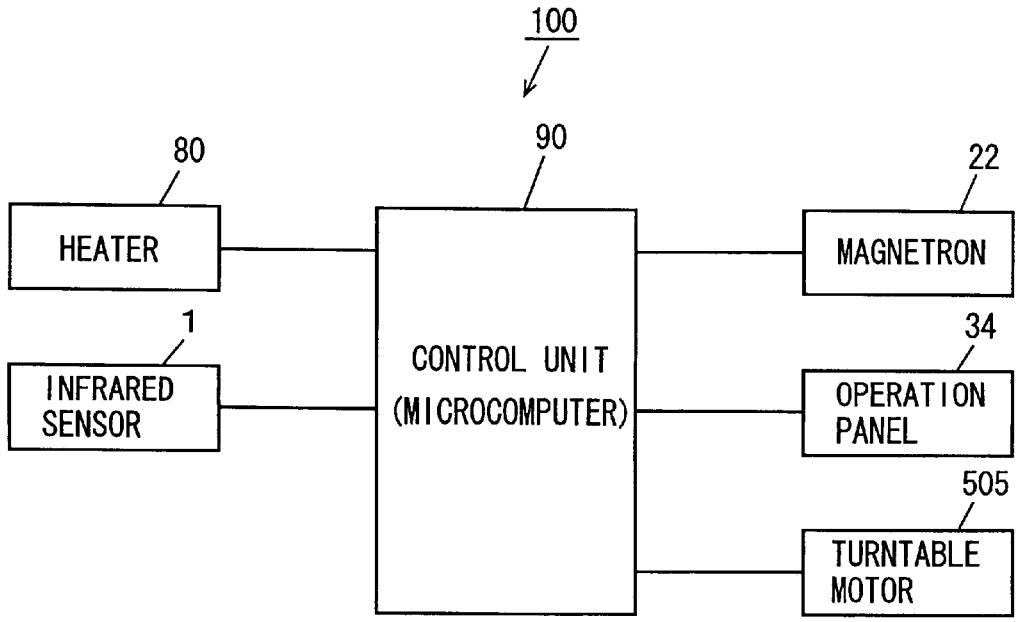
FIG. 3 is a block diagram showing the main electrical structure of the microwave oven of FIG. 1.

FIG. 3 is a block diagram showing the main electrical components of microwave oven 100 of FIGS. 1 and 2. Referring to FIG. 3, microwave oven 100 includes infrared sensor 1, turntable motor 505, magnetron 22, operation panel 34, heater 80, and control unit 90.

In microwave oven 100, infrared sensor 1 senses infrared radiation emitted from foodstuff 31. Control unit 90 determines the temperature of foodstuff 31 according to the amount of infrared radiation sensed by infrared sensor 1.

The change of the temperature of foodstuff 31 determined by control unit 90 according to the amount of infrared radiation sensed by infrared sensor 1 (referred to as detected temperature hereinafter) over heating time will be described now.

Figure 4:
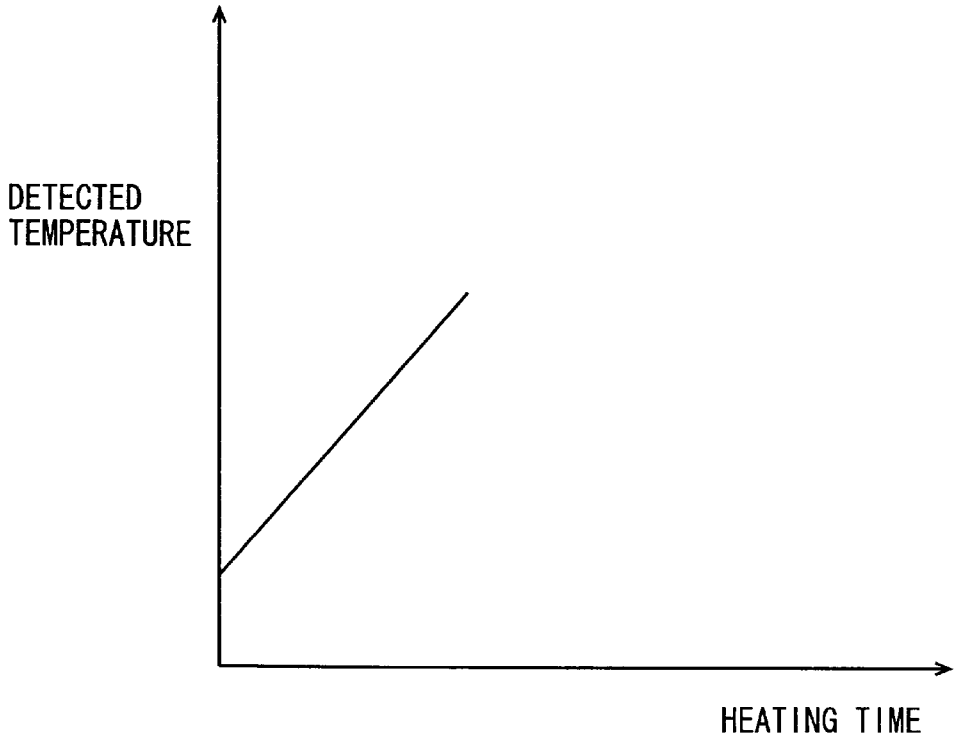
FIG. 4 represents the detected temperature over the heating time when one foodstuff is placed at the center of the turntable of the microwave oven of FIG. 1.

First, the change in the detected temperature over the heating time in the case where one foodstuff is placed at the center of turntable 18 is shown in FIG. 4. An example of one foodstuff is one cup of milk on turntable 18, as shown in FIG. 2. Other examples of one foodstuff are one bottle of liquor or one bowl of lice.

It is appreciated from FIG. 4 that the detected temperature rises at substantially the same rate in accordance with the elapse of the heating time. This is because the relative position between foodstuff 31 and infrared sensor 1 does not change so much even when turntable 18 rotates. The surface area of foodstuff 31 present within the region where infrared radiation can be detected by infrared sensor 1 (referred as sense field of infrared sensor 1) and the altitude of foodstuff 31 within the sense field do not change so greatly. The sense field of infrared sensor 1 is the conical 4 region including sense hole 19 with infrared sensor 1 as the vertex and inside heating chamber 17.

1. Heating control corresponding to number of foodstuffs on turntable

Figure 5:
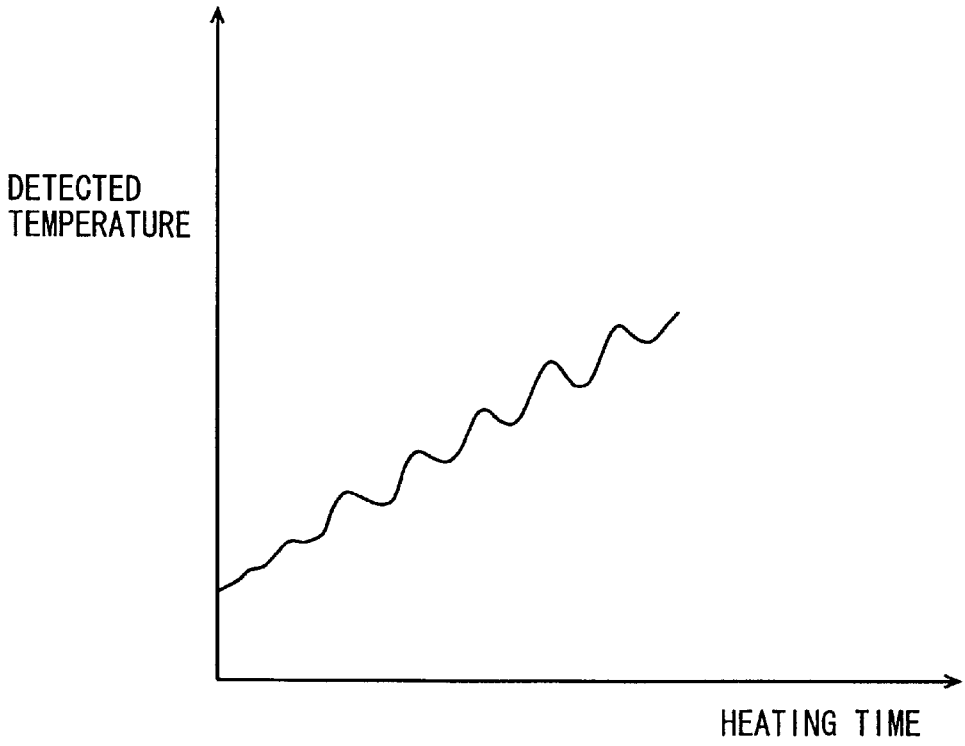
FIG. 5 represents the detected temperature over the heating time when a plurality of foodstuffs are mounted on the turntable of the microwave oven of FIG. 1.
Figure 6:
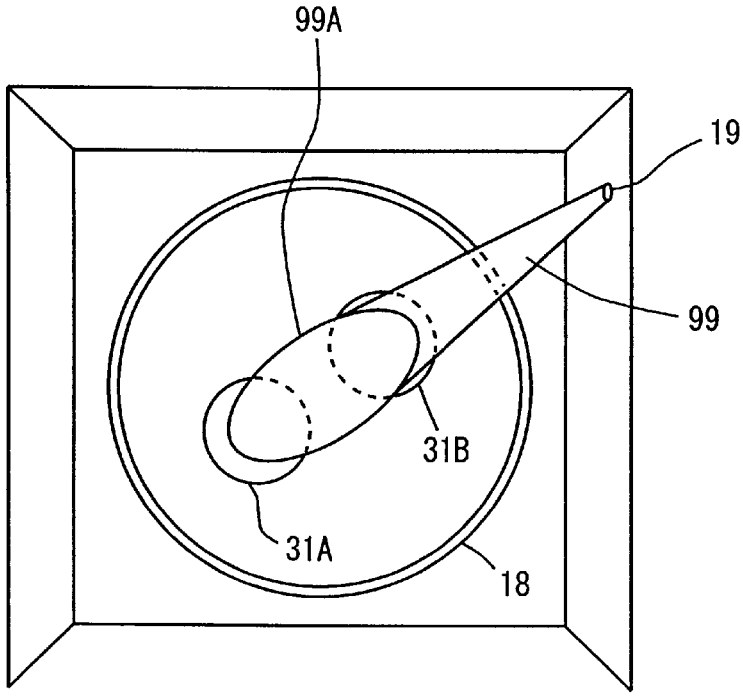
FIGS. 6–9 show two foodstuffs placed on the turntable of the microwave oven of FIG. 1 together with the sense field of the infrared sensor.
Figure 7:
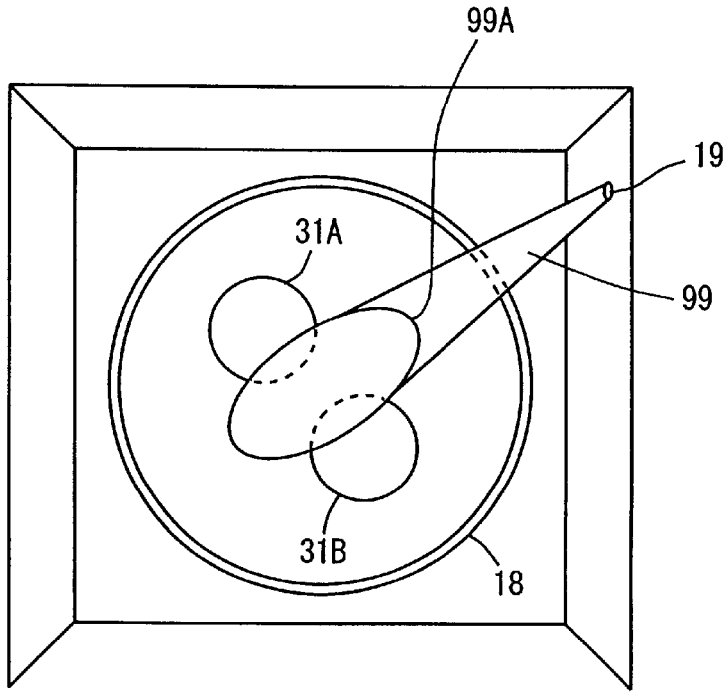
Figure 8:
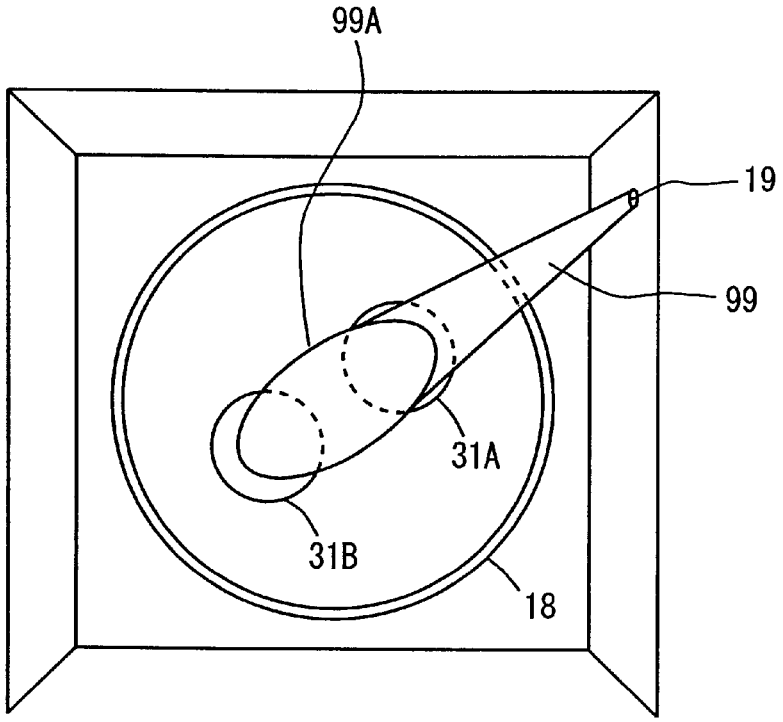
Figure 9:
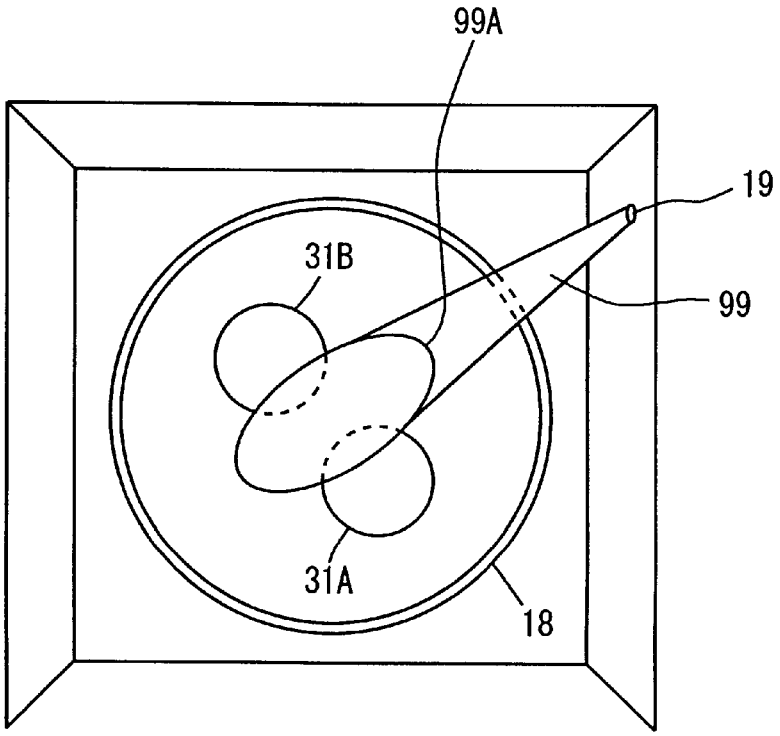

Change in the detected temperature in accordance with elapse of the heating time when a plurality of foodstuffs are placed on turntable 18 is shown in FIG. 5.

It is appreciated from FIG. 5 that the detected temperature rises and then repeats a rise and fall at a constant cycle to rise generally over the heating time.

This is attributed to the change in the surface area and altitude of the foodstuff within the sense field of infrared sensor 1 during one rotation of turntable 18. The change in the surface area and altitude of the foodstuff within the sense field of infrared sensor 1 during one rotation of turntable 18 will be described hereinafter.

The case where two foodstuffs (foodstuff 31A and foodstuff 31B) are placed on turntable 18 will be described with reference to FIGS. 6–9 showing the interior of heating chamber 17 viewed from above. Infrared sensor 1 has a sense field 99. Region 99A is the circular cross section of sense field 99 intersected by turntable 18, corresponding to the base of the cone of sense field 99.

The disposition of foodstuff 31A and foodstuff 31B in heating chamber 17 sequentially varies as in FIGS. 6–9 over one rotation of turntable 18 clockwise in the drawing. From the standpoint of stability, a foodstuff generally has a larger lateral width in the downward direction. Therefore, the surface area and the attitude of foodstuffs 31A and 31B within sense field 99 are most expansive and highest at the state of FIGS. 6 and 8 during one rotation of turntable 18. In contrast, the surface area and the altitude of foodstuffs 31A and 31B within sense field 99 are smallest and lowest at the state of FIGS. 7 and 9 during that one rotation of turntable 18.

Consider the case where the temperature of foodstuff 31A and foodstuff 31B does not change during one rotation of turntable 18. In the transition from the state of FIG. 6 to the state of FIG. 7 during the rotation of turntable 18, the surface area and the altitude of foodstuff 31A and foodstuff 31B within sense field 99 become smaller and lower. Therefore, the amount of infrared radiation detected by infrared sensor 1 decreases in the transition from the state of FIG. 6 to the state of FIG. 7. In contrast, the amount of infrared radiation sensed by infrared sensor 1 increases in the transition from the state of FIG. 7 to the state of FIG. 8 since the surface area and the altitude of foodstuff 31A and foodstuff 31B become larger and higher in sense field 99. Similarly, the amount of infrared radiation sensed by infrared sensor 1 decreases in the transition from the state of FIG. 8 to the state of FIG. 9 and increases in the transition from the state of FIG. 9 to the state of FIG. 6. Increase in the amount of infrared radiation detected by infrared sensor 1 results in a higher detected temperature. The detected temperature will become lower when the amount of infrared radiation decreases. More specifically, the detected temperature changes so as to exhibit two maximum values (corresponding to the states of FIGS. 6 and 8), and two minimum values (corresponding to the states of FIGS. 7 and 9) during the rotation cycle T of turntable 18 when two foodstuffs are placed on turntable 18. By continuing the heating operation of foodstuff 31A and foodstuff 31B by magnetron 22, the temperature of foodstuff 31A and foodstuff 31B determined by control unit 90 changes so as to exhibit a maximum value and a minimum value while generally rising.

Figure 10A:
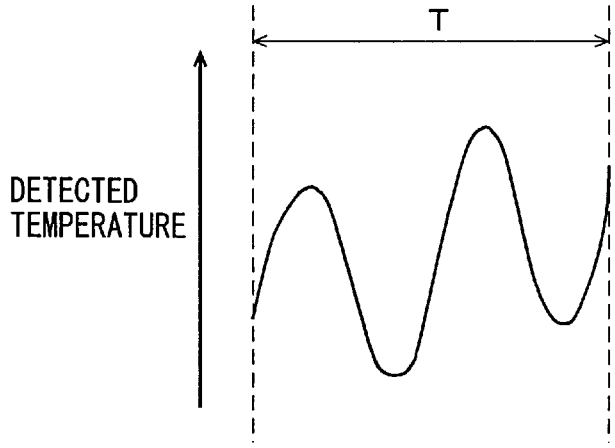
FIGS. 10A–10C represent the change in the detected temperature during a rotation cycle T of the turntable when a plurality of foodstuffs are placed on the turntable of the microwave oven of FIG. 1.

Thus, the detected temperature repeats a rise and fall to generally rise as shown in FIG. 5 when a plurality of foodstuffs are placed on turntable 18. The change in the detected temperature over a rotation cycle T of turntable 18 corresponding to the case where two foodstuffs are placed on turntable 18 is particularly shown in FIG. 10A with a portion of FIG. 5 enlarged. Referring to FIG. 10A, the first maximum value of the detected temperature corresponds to the state of FIG. 6. The first minimum value of the detected temperature corresponds to the state of FIG. 7. The second maximum value corresponds to the state of FIG. 8 whereas the second minimum value corresponds to the state of FIG. 9.

Figure 10B:
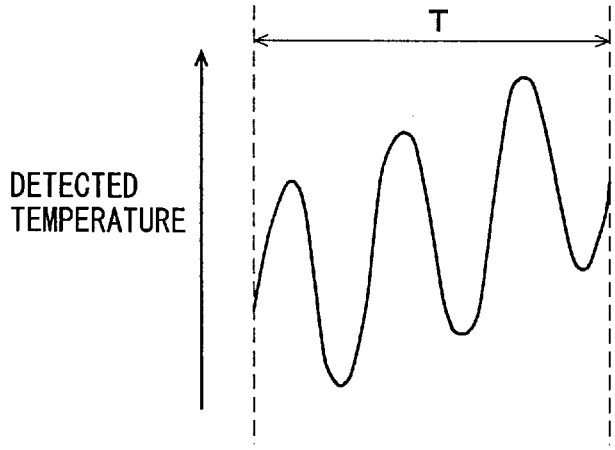
Figure 10C:
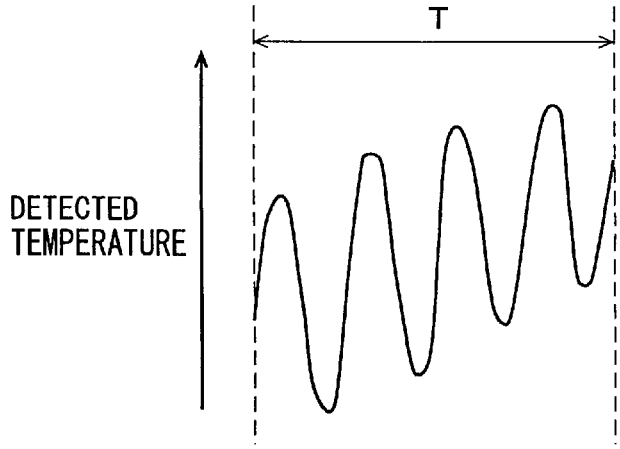

The change in the detected temperature over one rotation cycle T corresponding to the cases where three foodstuffs and four foodstuffs are placed on turntable 18 is shown in FIGS. 10B and 10C, respectively. In a similar manner, the detected temperature generally rises while repeating a rise and fall even when there are three or four foodstuffs placed on turntable 18. It is to be noted that there are three maximum values and three minimum values when three foodstuffs are mounted (refer to FIG. 10B). There are four maximum values and four minimum values when four foodstuffs are mounted (refer to FIG. 10C). In other words, when there are n foodstuffs placed on turntable 18, the detected temperature generally rises while repeating a rise and a fall, and exhibits n maximum values and n minimum values during one rotation cycle T.

In microwave oven 100 of the present embodiment, control unit 90 detects the number of foodstuffs placed on turntable 18 according to the number of maximum values or minimum values of detected temperature during rotation cycle T.

The preset cooking menu of microwave oven 100 includes the "liquor heating" menu and "milk heating" menu that conducts heating by magnetron 22. Control unit 90 determines the set temperature of the foodstuff in either menu according to the detected number of foodstuffs. In the execution process of the menu, control unit 90 stops the heating by magnetron 22 when the detected temperature arrives at the set temperature.

The operation of control unit 90 according to the menu will be described with reference to FIG. 11. Upon entry of an instruction to start heating by the user, control unit 90 energizes high-voltage transformer 33, whereby heating is initiated by magnetron 22 at S1.

At S2, the number of generated of extrema (either the maximum value or the minimum value) of the detected temperature during rotation cycle T of turntable 18 is detected.

The control proceeds to S3 when the number of times of generation is 1 or below assuming that the number of foodstuffs is 1. When the number of times of generation is 2, control proceeds to S4 assuming that the number of foodstuffs is 2. When the number of times of generation is 3, control proceeds to S5 assuming that the number of foodstuffs is 3. When the number of times of generation is 4 or more, control proceeds to S6 assuming that there are four or more foodstuffs. At S3–S6, the set temperature is adjusted to D1–D4, respectively. Then, control proceeds to S7. The relationship of set temperatures D1–D4 is established as D1<D2<D3<D4.

At S7, the process of determining the detected temperature is carried out on the basis of the amount of infrared radiation sensed by infrared sensor 1. Then, control proceeds to S8. Determination of the detected temperature at S7 is made on the basis of the average of the amount of infrared radiation values sensed by infrared sensor 1 during a constant time (for example, one second).

At S8, determination is made whether the detected temperature determined at S7 has arrived at the set temperature of any of S3–S6. Control returns to S7 when determination is made that the set temperature has not yet been reached, otherwise, to S9. The processes of S7 and S8 are repeated until the detected temperature reaches the set temperature. Then, the heating operation by magnetron 22 is ceased by suppressing the energization to high-voltage transformer 33.

In the above-described embodiment, the heating means to heat the foodstuff in the heating chamber corresponds to magnetron 22. The turntable on which the foodstuff is placed and that rotates at a predetermined cycle corresponds to turntable 18 on which foodstuff 31 is placed and that rotates at the rotation cycle of T. The infrared sense unit sensing infrared radiation emitted from the foodstuff in the heating chamber corresponds to infrared sensor 1 that catches the infrared radiation emitted from foodstuff 31. The control unit that determines the number of foodstuffs according to the number of extrema for the infrared radiation sensed over a predetermined cycle and that drives the heat unit according to the determined number of foodstuffs corresponds to control unit 90 that executes various processes shown in FIG. 11.

Figure 11:
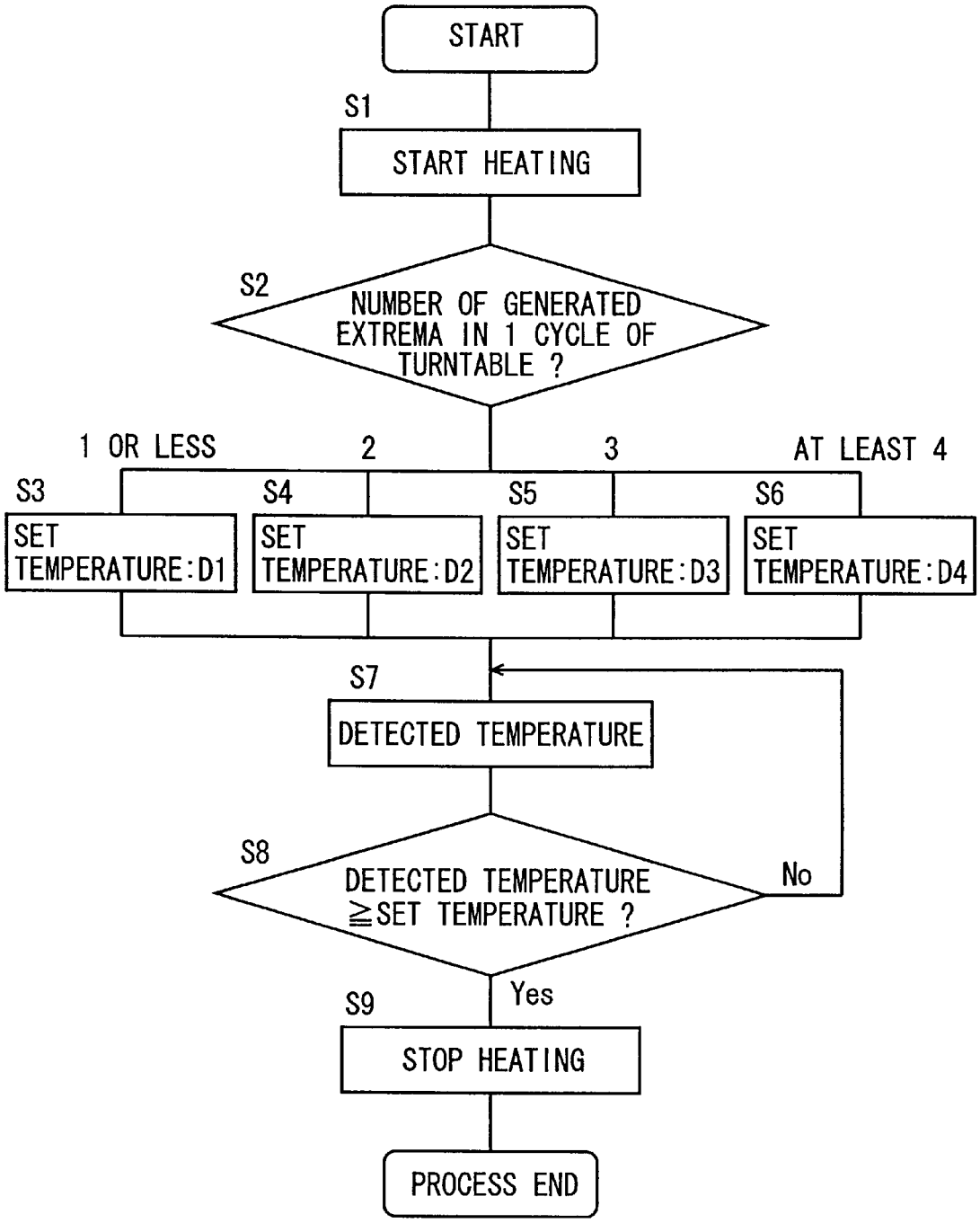
FIG. 11 represents the operation of the control unit when heating is 10 effected according to a cooking menu in the microwave oven of FIG. 1.

Control unit 90 carries out the processes of FIG. 11. The relationship of set temperatures D1–D4 is established as D1<D2<D3<D4. Thus, the control unit is configured to determine a higher set temperature in proportion to the determined greater number of foodstuffs, determine the temperature of the foodstuff according to the sensed amount of infrared radiation, and drive the heat unit so as to heat the foodstuff until the detected temperature of the foodstuff arrives at the set temperature.

Figure 12:
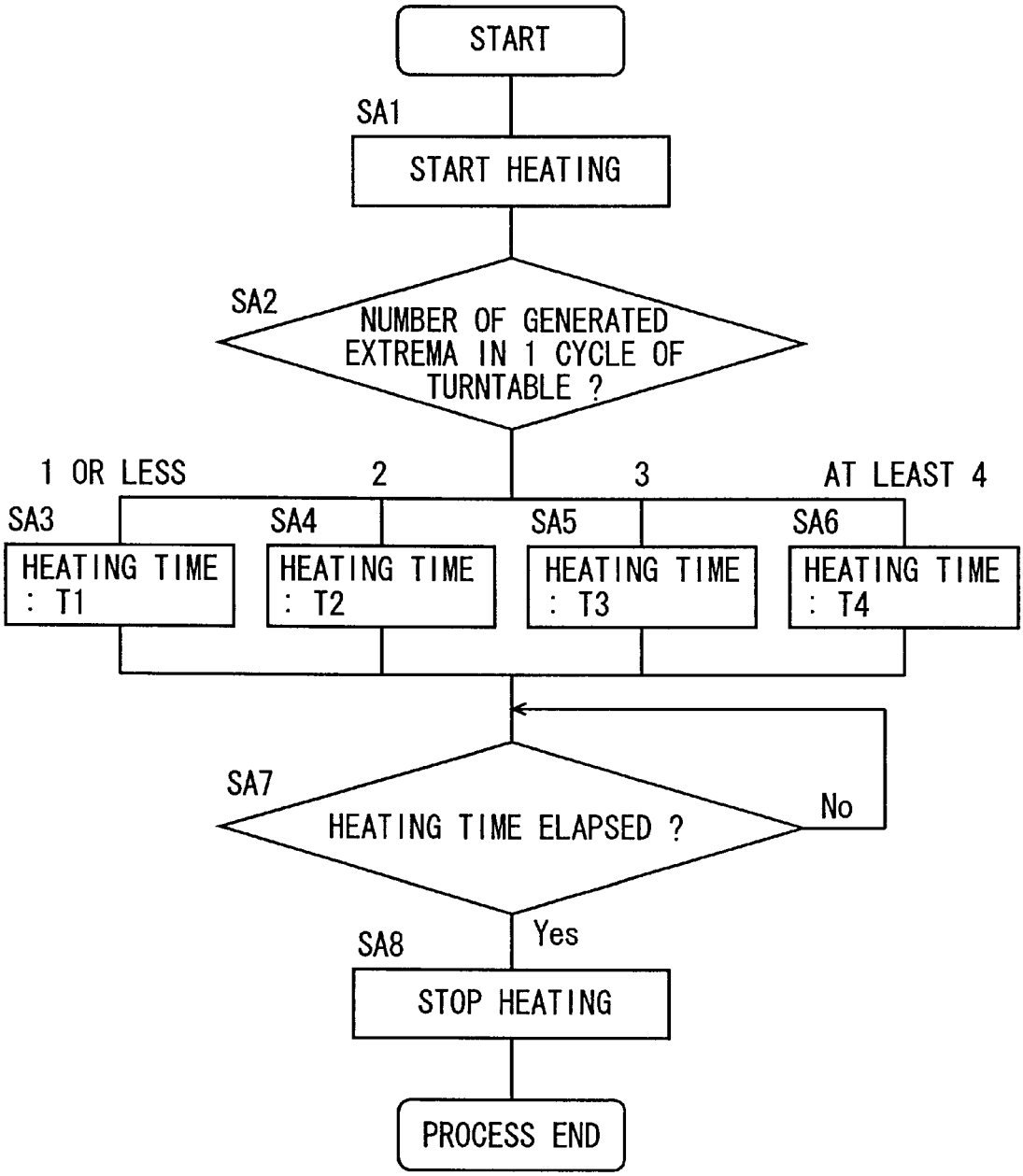
FIG. 12 is a modification of the operation of the control unit of FIG. 11.

In the present embodiment, control unit 90 can determine the heating time instead of the set temperature according to the number of foodstuffs. This process of control unit 90 is shown in FIG. 12.

Similar to S1 and S2, heating is initiated at SA1 and the number of generated extrema is detected at SA2. Control proceeds to SA3, SA4, SA5, or SA6 to set the heating time to T1, T2, T3, or T4, when the number of generated extrema is less than 1, equal to 2, equal to 3, or at least 4, respectively. Then, control proceeds to SA7. The relationship of heating time T1–T4 is established as T1<T2<T3<T4.

At SA7, determination is made whether the heating time set by any of SA3–SA6, starting from the heating of SA1, elapsed or not. The processes upto SA7 are repeated until determination is made of the elapse of the heating time. Then, control proceeds to SA8. At SA8, the heating operation is stopped, likewise S9.

By this modification, the control unit is configured to determine a longer set time in proportion to a larger number of foodstuffs, and to drive the heat unit so as to heat the foodstuff for the set time. The set time corresponds to any of heating time T1–T4 set by SA3–SA6, respectively.

Under control of the process described with reference to FIG. 12, the number of foodstuffs 31 can be detected without using a weight sensor in microwave oven 100. Since the number of foodstuffs 31 can be detected, a heating time corresponding to the number of foodstuffs 31 can be determined. Some conventional microwave ovens are provided with a humidity sensor that senses the heating progress of the foodstuff to determine the heating time according to the output from the humidity sensor. Such a microwave oven is disadvantageous in that the heating time cannot be set when the consummation temperature of the foodstuff corresponds to a temperature where the foodstuff will not exhibit so much moisture. In contrast, under control of the process of FIG. 12 in microwave oven 100 of the present invention, the preferable heating time corresponding to the number of foodstuffs 31 can be determined.

The advantages of the present invention will be described hereinafter focusing on the advantage under control of the process described with reference to FIG. 11 by microwave oven 100.

Table 1 represents the measured temperature when heating is effected according to the automatic menu of "liquor heating" ("liquor" in Table 1) and "milk heating" ("milk" in Table 1) by microwave oven 100. The label of "EMBODIMENT" in Table 1 refers to the case where heating is carried out according to various set temperatures corresponding to the detected number of foodstuffs by control unit 90 as shown in FIG. 11. "COMPARATIVE EXAMPLE" refers to heating carried out without varying the preset temperature by control unit 90 even if the number of foodstuffs changes in microwave oven 100 for the respective automatic menus. Table 1 represents the actual consummated temperature of each foodstuff when heating is carried out with different number of foodstuffs (different number of bottles for liquor heating and different number of cups for milk heating) by microwave oven 100. The relevant set temperature is shown under the consummated temperature in each column of Table 1. Here, the actual consummated temperature is the temperature of the liquor or milk stirred after the heating operation.

TABLE 1

(Unit: ° C.)

| Menu | No. | EMBODIMENT Variable Set Temperature | COMPARATIVE EXAMPLE Fixed Set Temperature |
|---|---|---|---|
| Liquor | 1 | 55.0 | 56.1 |
| | | Set temp.: 45 | Set temp.: 45 |
| | 2 | 51.5/55.8 | 44.9/47.4 |
| | | Set temp.: 60 Ave. 53.7 | Set temp.: 45 Ave. 46.2 |
| | 3 | 53.0/55.3/56.3 | 37.6/38.0/38.0 |
| | | Set temp.: 70 Ave. 54.9 | Set temp.: 45 Ave. 37.9 |
| | 4 | 53.4/53.5/52.5/51.4 | 37.0/35.8/36.8/36.2 |
| | | Set temp.: 75 Ave. 52.7 | Set temp.: 45 Ave. 36.5 |
| Milk | 1 | 56.4 | 63.0 |
| | | Set temp.: 46 | Set temp.: 50 |
| | 2 | 55.2/57.2 | 43.2/43.2 |
| | | Set temp.: 66 Ave. 56.2 | Set temp.: 50 Ave. 43.2 |
| | 3 | 55.2/55.8/57.1 | 37.8/39.1/37.3 |
| | | Set temp.: 75 Ave. 56.0 | Set temp.: 50 Ave. 38.1 |
| | 4 | 53.2/57.5/55.8/57.5 | 30.8/31.8/30.7/30.7 |
| | | Set temp.: 80 Ave. 56.0 | Set temp.: 50 Ave. 31.0 |

Ave.: Average temperature

First, "liquor heating" will be described.

It is appreciated from Table 1 that, when determination is made that there is one bottle of liquor in EMBODIMENT, the heating operation is carried out until the detected temperature by control unit 90 becomes 45° C. When determination is made that there are two bottles of liquor, the heating operation is continued until the detected temperature by control unit 90 becomes 60° C. When determination is made that there are three bottles of liquor, the heating operation is carried out until the detected temperature by control unit 90 arrives at 70° C. When determination is made that there are four bottles of liquor, the heating operation is carried out until the detected temperature by control unit 90 arrives at 75° C.

By the above heating operation, the measured temperature of the stirred liquor was 55° C. for one bottle of liquor, the average measured temperature was 53.7° C. for two bottles of liquor, the average measured temperature was 54.9° C. for three bottles of liquor, and the average measured temperature was 52.7° C. for four bottles of liquor.

In COMPARATIVE EXAMPLE, the set temperature is always 45° C. irrespective of the number of bottles. The measured temperature was 56.1° C. for one bottle of liquor, the average measured temperature was 46.2° C. for two bottles of liquor, the average measured temperature was 37.9° C. for three bottles of liquor, and the average measured temperature was 36.50° C. for four bottles of liquor. Thus, there is a tendency that the actual consummated temperature becomes lower as the number of bottles increases since the set temperature is constant irrespective of the increase in the number of bottles in COMPARATIVE EXAMPLE.

In EMBODIMENT, the actual consummated temperature shows almost no variation even though there are different number of bottles since heating is conducted automatically on the basis of a higher set temperature corresponding to a greater number of bottles. Therefore, the liquor is always heated to the optimum temperature irrespective of the number of bottles.

Next, the case of "milk heating" will be described.

It is appreciated from Table 1 that the heating operation is continued until the detected temperature by control unit 90 becomes 46° C. when determination is made that there is one cup of milk in EMBODIMENT. When determination is made that there are two cups of milk, the heating operation is continued until the detected temperature by control unit 90 becomes 66° C. When determination is made that there are three cups of milk, the heating operation is continued until the detected temperature by control unit 90 becomes 75° C. When determination is made that there are four cups of milk, the heating operation is continued until the detected temperature by control unit 90 becomes 80° C.

According to the above heating operation, the measured temperature of milk after stirring was 56.4° C. for one cup of milk, the average measured temperature was 56.2° C. for two cups of milk, the average measured temperature was 56.0° C. for three cups of milk, and the average measured temperature was 56.0° C. for four cups of milk.

In COMPARATIVE EXAMPLE, the set temperature is always 50° C. irrespective of the number of cups. The measured temperature was 63.0° C. for one cup of milk, the average measured temperature was 43.2° C. for two cups of milk, the average measured temperature was 38.1° C. for three cups of milk, and the average measured temperature was 31.0° C. for four cups of milk. Therefore, there is a tendency that the actual consummated temperature becomes lower as there are a greater number of cups since the set temperature is constant irrespective of the increase in the number of cups in COMPARATIVE EXAMPLE.

In EMBODIMENT, the heating operation is carried out according to a higher set temperature automatically corresponding to increase in the number of cups. Therefore, the actual consummated temperature does not substantially change even if the number of cups differ. Therefore, the milk is always heated to the optimum temperature regardless of how many cups there are.

Thus, a constant consummated temperature can be realized for the foodstuff irrespective of the number of foodstuffs to be heated in microwave oven 100 of the present embodiment under control of the process described with reference to FIG. 11.

Figure 13:
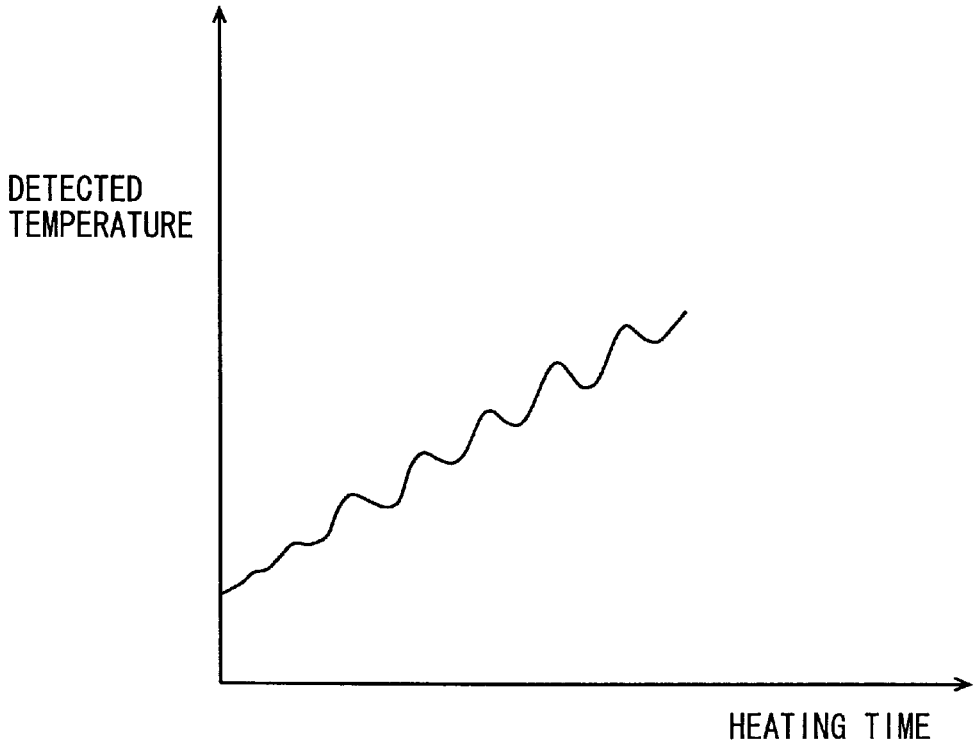
FIG. 13 represents the detected temperature over heating time when the foodstuff is placed at the edge of the turntable of the microwave oven of FIG. 1.

2. Heating control corresponding to the mounted position of foodstuff on turntable FIG. 13 shows the change in detected temperature over heating time when foodstuff 31 is placed, not at the center of the turntable 18, but at the edge of turntable 18. It is appreciated from FIG. 13 that the detected temperature first rises, and then repeats a rise and a fall to generally rise as the heating time elapses. This is because the surface area of foodstuff 31 within the sense field of infrared sensor 1 and the altitude of foodstuff 31 in the height direction changes during one rotation of turntable 18. This change in the surface area and altitude of foodstuff 31 within the sense field of infrared sensor 1 during one rotation of turntable 18 are described with reference to FIGS. 14–17. FIGS. 14–17 schematically show the interior of heating chamber 17 viewed from above, similar to FIGS. 6–9. Infrared sensor 1 includes sense field 99. Region 99A is the circular cross section of sense field 99 intersected by turntable 18, corresponding to the base of the cone of sense field 99.

The disposition of foodstuff 31 in heating chamber 17 varies in the order of FIGS. 14–17 during one rotation of turntable 18 clockwise in the drawings. From the point of stability, foodstuff generally has a greater lateral width in the downward direction. Therefore, the surface area and altitude of foodstuff 31 within sense field 99 are substantially identical in the states of FIGS. 14, 16 and 17. However, the surface area is more expansive and the altitude higher in the state of FIG. 15 than the other states.

Figure 14:
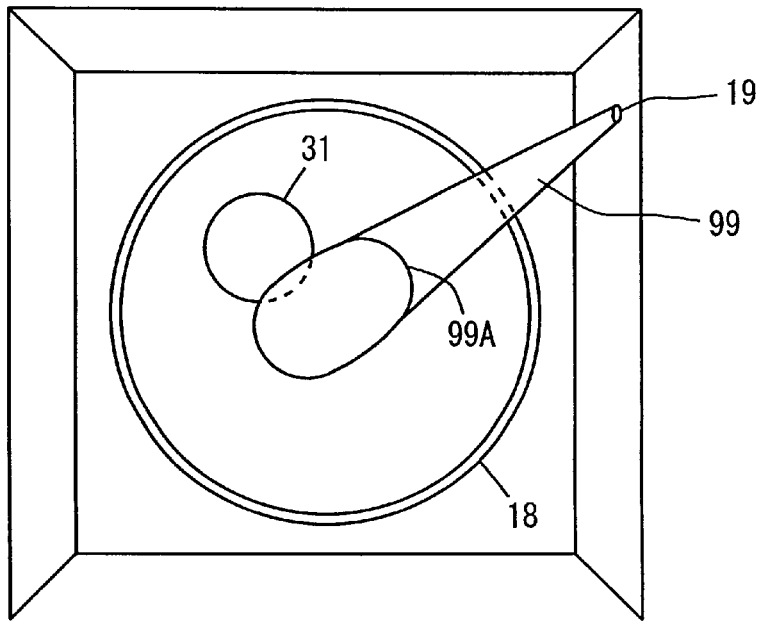
FIGS. 14–17 show the foodstuff placed at the edge of the turntable of the microwave oven of FIG. 1 together with the sense field of the infrared sensor.
Figure 15:
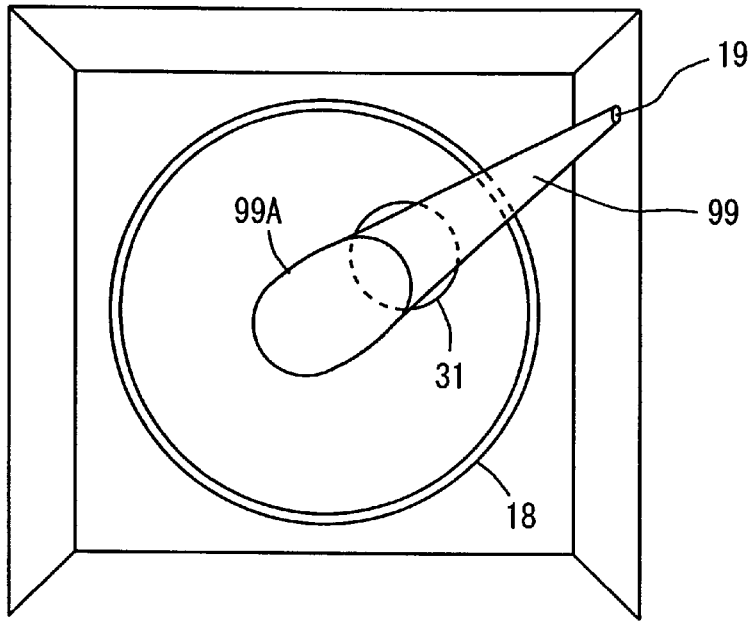
Figure 16:
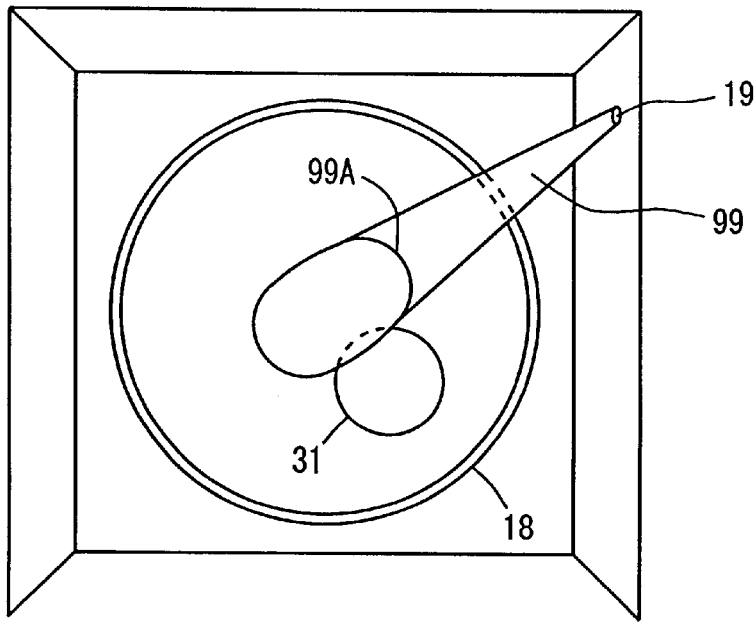
Figure 17:
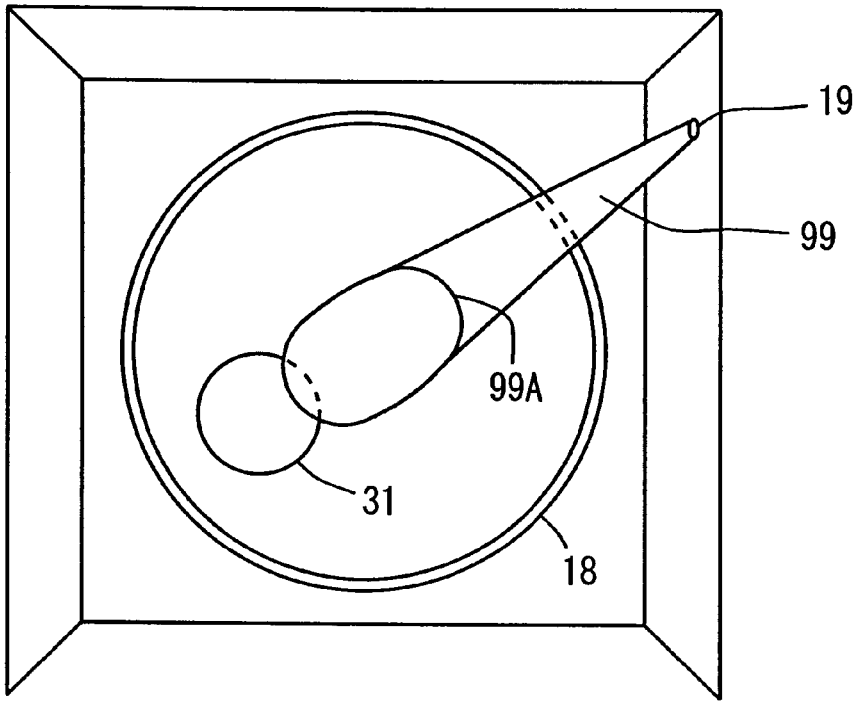

Assuming the case where the temperature of foodstuff 31 does not change during one rotation of turntable 18, the surface area and the altitude of foodstuff 31 within sense field 99 increase in the transition from the state of FIG. 14 to the state of FIG. 15 according to the rotation of turntable 18. Therefore, the amount of infrared radiation sensed by infrared sensor 1 increases. In the transition from the state of FIG. 15 to the state of FIG. 16, the amount of infrared radiation sensed by infrared sensor 1 decreases since the surface area and altitude of foodstuff 31 within sense field 99 becomes smaller. There is no great change in the surface area and the altitude of foodstuff 31 within sense field 99 in the transition of the state from FIG. 16 to FIG. 17 and in the transition from the state of FIG. 17 to FIG. 14.

The detected temperature of foodstuff 31 is determined by control unit 90 according to the amount of infrared radiation sensed by infrared sensor 1. The detected temperature rises and falls as the amount of infrared radiation detected by infrared sensor 1 increases and decrease, respectively. The detected temperature does not change if there is no change in the amount of sensed infrared radiation. When foodstuff 31 is mounted at the edge, not the center, of turntable 18 as described with reference to FIGS. 14–17, the detected temperature varies to exhibit one maximum value (corresponding to the detected temperature of the state of FIG. 15) during one rotation cycle T of turntable 18. If foodstuff 31 is continued to be heated by magnetron 22, the temperature of foodstuff 31 determined by control unit 90 generally increases while varying to exhibit a maximum value.

Figure 18:
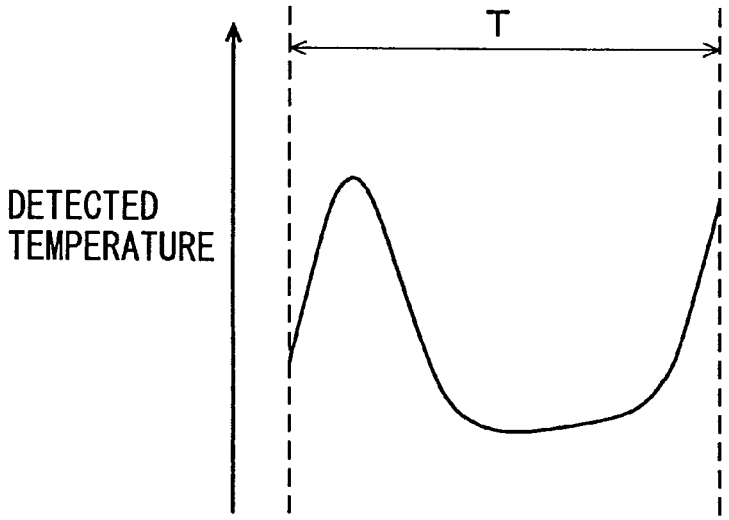
FIG. 18 represents change in the detected temperature during a rotation cycle T of the turntable when the foodstuff is placed at the edge of the turntable as shown in FIGS. 14–17.

Therefore, the detected temperature repeats a rise and a fall to generally increase as shown in FIG. 13 when foodstuff 31 is mounted at the edge of turntable 18. The change in the detected temperature over a rotation cycle T of turntable 18 when the foodstuff is placed on turntable 18 as described with reference to FIGS. 14–17 is shown in FIG. 18 with a portion from FIG. 13 enlarged. In FIG. 18, the maximum value corresponds to the detected temperature of the state of FIG. 15.

The change in the detected temperature when the distance between foodstuff 31 and the center of turntable 18 is altered will be described hereinafter. FIGS. 19–22 show foodstuff 31 placed closer to the center of turntable 18 than the position shown in FIGS. 14–17 together with sense field 99 of infrared sensor 1.

Figure 19:
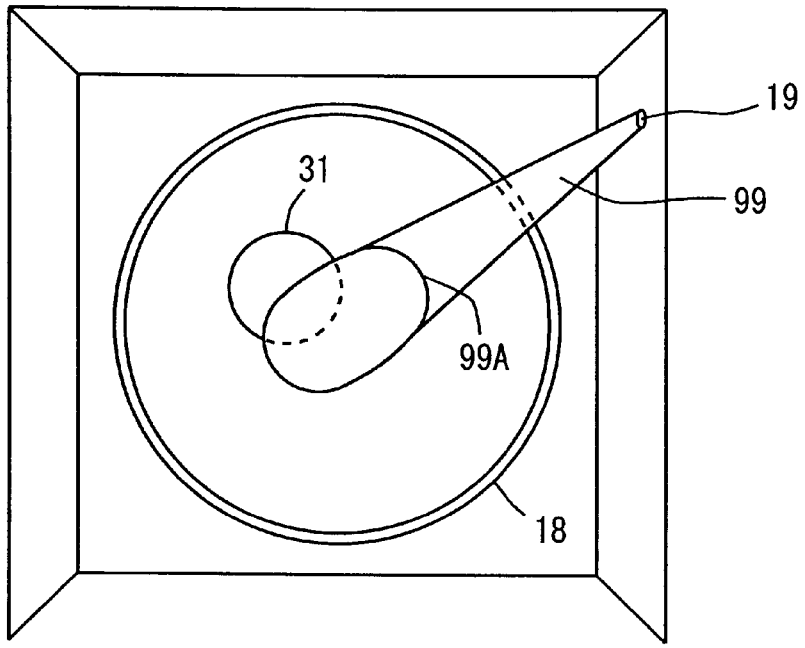
FIGS. 19–22 show the foodstuff placed at the edge of the turntable of the microwave oven of FIG. 1 together with the sense field of the infrared sensor.
Figure 20:
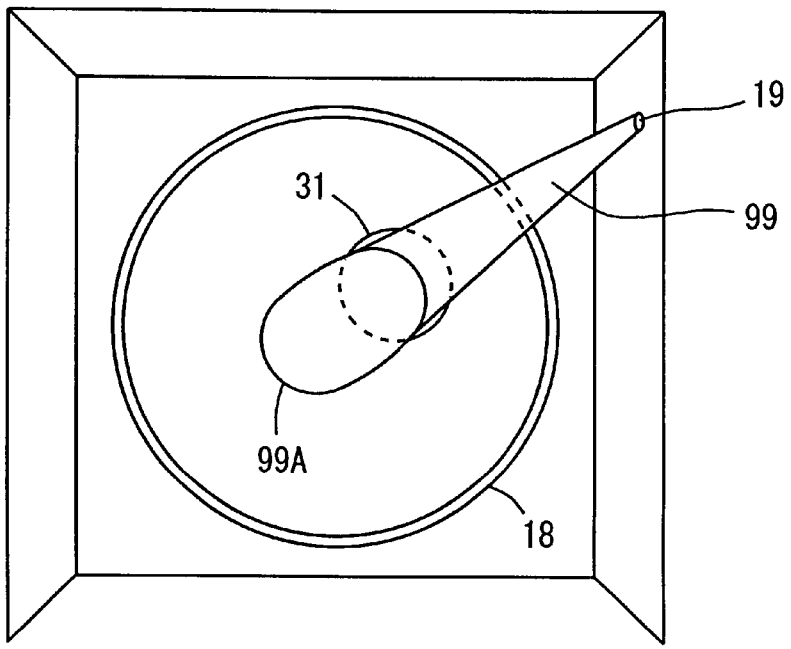
Figure 21:
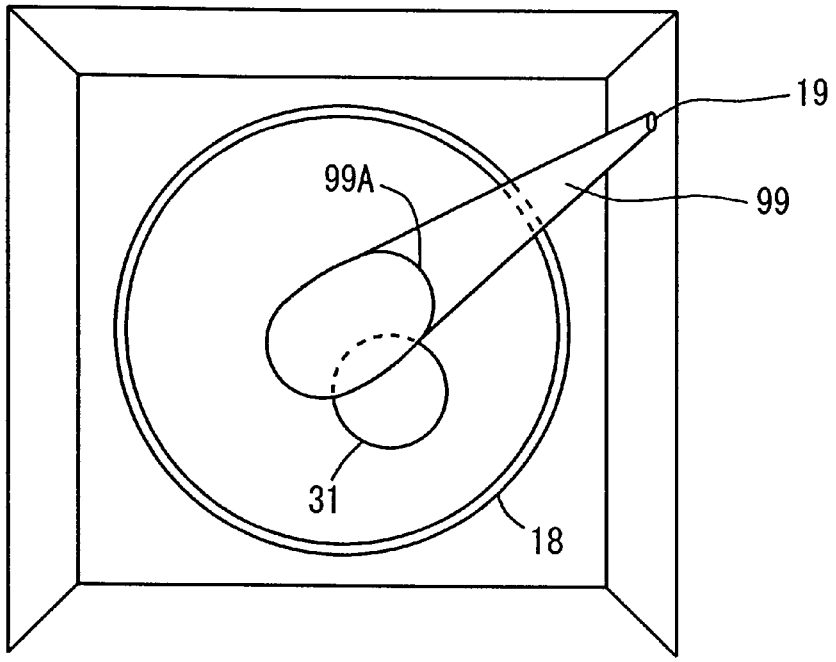
Figure 22:
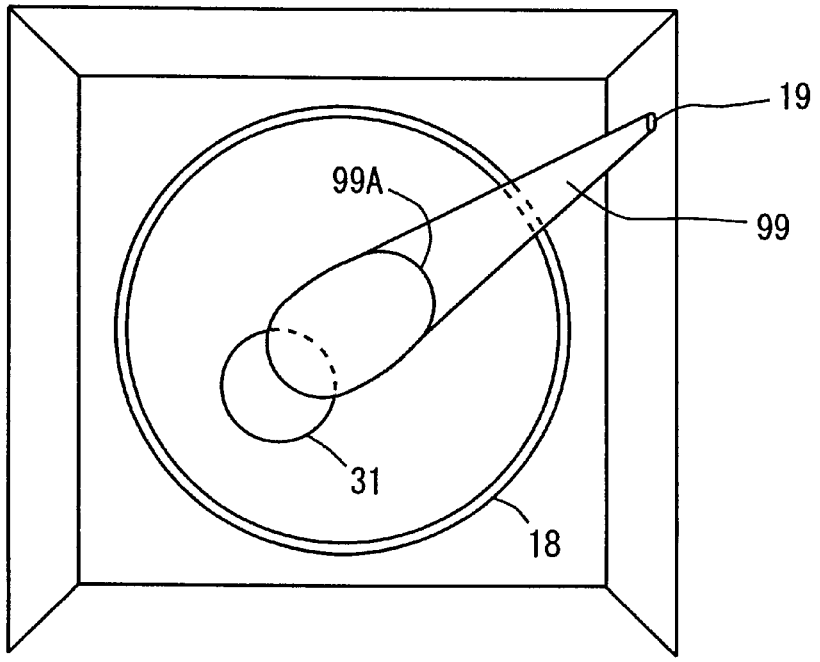

The disposition of foodstuff 31 in heating chamber 17 sequentially varies as shown in FIGS. 19–22 during one clockwise rotation of turntable 18. In the states of FIGS. 19, 21 and 22, the surface area and altitude of foodstuff 31 within sense field 99 are substantially identical. In the state of FIG. 20, the surface area and altitude of foodstuff 31 in sense field 99 are more expansive and higher.

FIGS. 19–22 correspond to FIGS. 14–17, respectively. More specifically, the amount of infrared radiation sensed by infrared sensor 1 increases in the transition from the state of FIG. 19 to the state of FIG. 20, as described with reference to FIGS. 14–17. The amount of infrared radiation sensed by infrared sensor 1 decreases in the transition of the state from FIG. 20 to the state of FIG. 21. There is no great change in the amount of infrared radiation sensed by infrared sensor 1 in the transition of the state from FIG. 21 to the state of FIG. 22 and the transition of the state from FIG. 22 to the state of FIG. 19. In other words, the detected temperature corresponding to the states of FIGS. 19–22 varies so as to exhibit one maximum value (corresponding to the detected temperature of the state of FIG. 20) and to generally rise during one rotation cycle T of turntable 18, as shown in FIG. 23.

Figure 23:
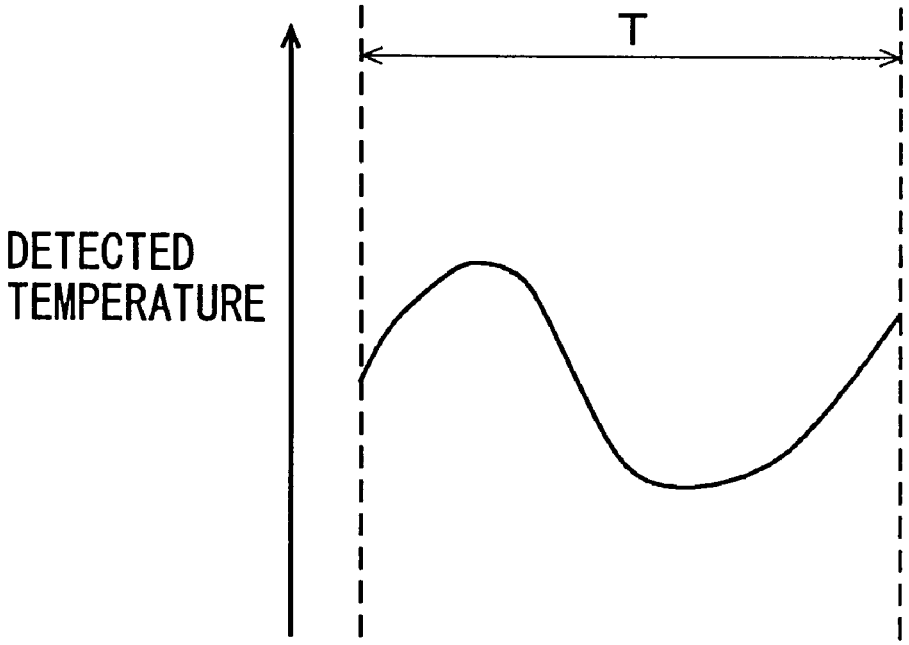
FIG. 23 represents change in the detected temperature during a rotation cycle T of the turntable when the foodstuff is placed at the edge of the turntable as shown in FIGS. 19–22.

In the comparison of FIGS. 18 and 23, the rate of change of the detected temperature in the vicinity of the maximum value is smaller in FIG. 23 than in FIG. 18 indicating the detected temperature when foodstuff 31 is mounted closer to the center of turntable 18. Therefore, the distance of foodstuff 31 from the center of turntable 18 can be detected on the basis of the rate of change of the detected temperature in the vicinity of the maximum value when foodstuff 31 is not mounted at the center of turntable 18 and when the detected temperature exhibits a maximum value in microwave oven 100.

As described with reference to FIG. 14, the detected temperature rises at a constant rate when foodstuff 31 is placed at the center of turntable 18 in microwave over 100 of the present embodiment. Also, the detected temperature exhibits one maximum value during one rotation cycle T and generally rises when foodstuff is mounted at the edge, as described with reference to FIG. 13. Taking the advantage of these features, detection is made by control unit 90 whether foodstuff 31 is mounted at the center of turntable 18 according to whether the detected temperature exhibits a maximum value during time T.

Microwave oven 100 includes a plurality of preset cooking menus. The cooking menu includes the menu of carrying out heating by magnetron 22 such as "liquor heating" and "milk heating". Control unit 90 determines the set temperature for the foodstuff in the cooking menu by magnetron 22 depending on whether foodstuff 31 is placed at the center of turntable 18 or not. Control unit 90 stops the heating operation by magnetron 22 at the time point the detected temperature arrives at the set temperature during execution of the menu.

The operation of control unit 90 according to the menu will be described hereinafter with reference to FIG. 24. Upon entry of an instruction to start the heating operation by the user, control unit 90 energizes high-voltage transformer 33 to carry out the process of initiating heating by magnetron 22 at S11. At S12, the process is carried out of determining whether the detected temperature measured over rotation cycle T of turntable 18 exhibits an extremum (maximum value) or not.

When there is no extremum, control proceeds to S13 to adjust the set temperature to E1. When there is an extremum, control proceeds to S14 to adjust the set temperature to E2. Then, control proceeds to S15. Set temperatures E1 and E2 have the relationship of E1<E2.

At S15, the process of determining the detected temperature from the amount of infrared radiation sensed by infrared sensor 1 is carried out. Then, control proceeds to S16. Determination of the detected temperature at S15 is carried out on the basis of the average values of the amount of infrared radiation sensed by infrared sensor 1 over a constant time (for example, one second).

At S16, determination is made whether the detected temperature determined at S15 has reached the set temperature of S13 or S14. If not, control returns to S15, otherwise to S17. The processes of S15 and S16 are repeated until the detected temperature reaches the set temperature. At S17, the heating operation by magnetron 22 is ceased by suppressing energization towards high-voltage transformer 33.

Thus, the actual consummated temperature of foodstuff 31 subject to the cooking operation can be set substantially constant irrespective of whether foodstuff 31 is placed at the center or at the edge of turntable 18 in microwave oven 100 under control during the heating operation of the process described with reference to FIG. 24.

In other words, the detected temperature exhibiting an extremum implies that foodstuff 31 is placed at a site remote from the center of turntable 18. In this case, set temperature (E2) becomes higher than the set temperature (E1) corresponding to the case where foodstuff 31 is placed at the center of turntable 18. There is a case where the detected temperature becomes higher momentarily when foodstuff 31 is placed remote from the center of turntable 18 than in the case placed at the center even when foodstuff 31 takes the same state (refer to FIG. 15). By setting the relationship of E1<E2, change in the detected temperature according to the disposition of foodstuff 31 can be corrected in microwave over 100.

It is appreciated from FIGS. 18 and 23 that the rate of change of the detected temperature in the vicinity of the maximum value becomes greater in proportion to the distance of foodstuff 31 from the center of turntable 18. Control unit 90 can sense the distance between foodstuff 31 and the center of turntable 18 according to the rate of change of the detected temperature in the vicinity of the maximum value. Taking advantage of these features, the temperature can be set in discrete small steps of E2, E3, E4 according to the distance between foodstuff 31 and turntable 18 detected from the rate of change instead of setting the temperature to E2 in S12 and S14 of FIG. 24 when the detected temperature exhibits an extremum. More specifically, the set temperature can be determined in the steps of E2, E3 and E4 by the change of rate in the detected temperature in the vicinity of the extremum, for example, between the detected temperature corresponding to an extremum and the temperature detected at a preceding constant period of time. The relationship of E2<E3<E4 is preferable when E2, E3 and E4 are determined starting from the smaller rate of change, i.e. closer to the center. The rate of change of the detected temperature corresponds to the amount of change in the detected temperature per unit time.

There are cases where the process corresponding to the center-mounted foodstuff on the turntable can be carried out without any problem even if foodstuff 31 is not placed at the center of turntable 18, provided that it is located substantially at the center, in microwave oven 100. No particular effect will be obtained even if a process differing from that of the center-located process is carried out. There is a possibility that a different process will only complicate the entire control. It is therefore preferable to proceed to S13 in the process described with reference to FIG. 24 even when determination is made that there is an extremum at S 12, as long as the rate of change of the detected temperature in the vicinity of the extremum is less than a predetermined value.

In the above-described embodiment, the heat unit that heats the foodstuff in the heating chamber corresponds to magnetron 22. The control unit that determines the mounted position of the foodstuff on the turntable depending upon whether the amount of infrared radiation sensed over a predetermined cycle exhibits an extremum or not, and that drives the heat unit according to the determined mounted position of the foodstuff corresponds to control unit 90 that executes the various processes shown in FIG. 24.

Figure 24:
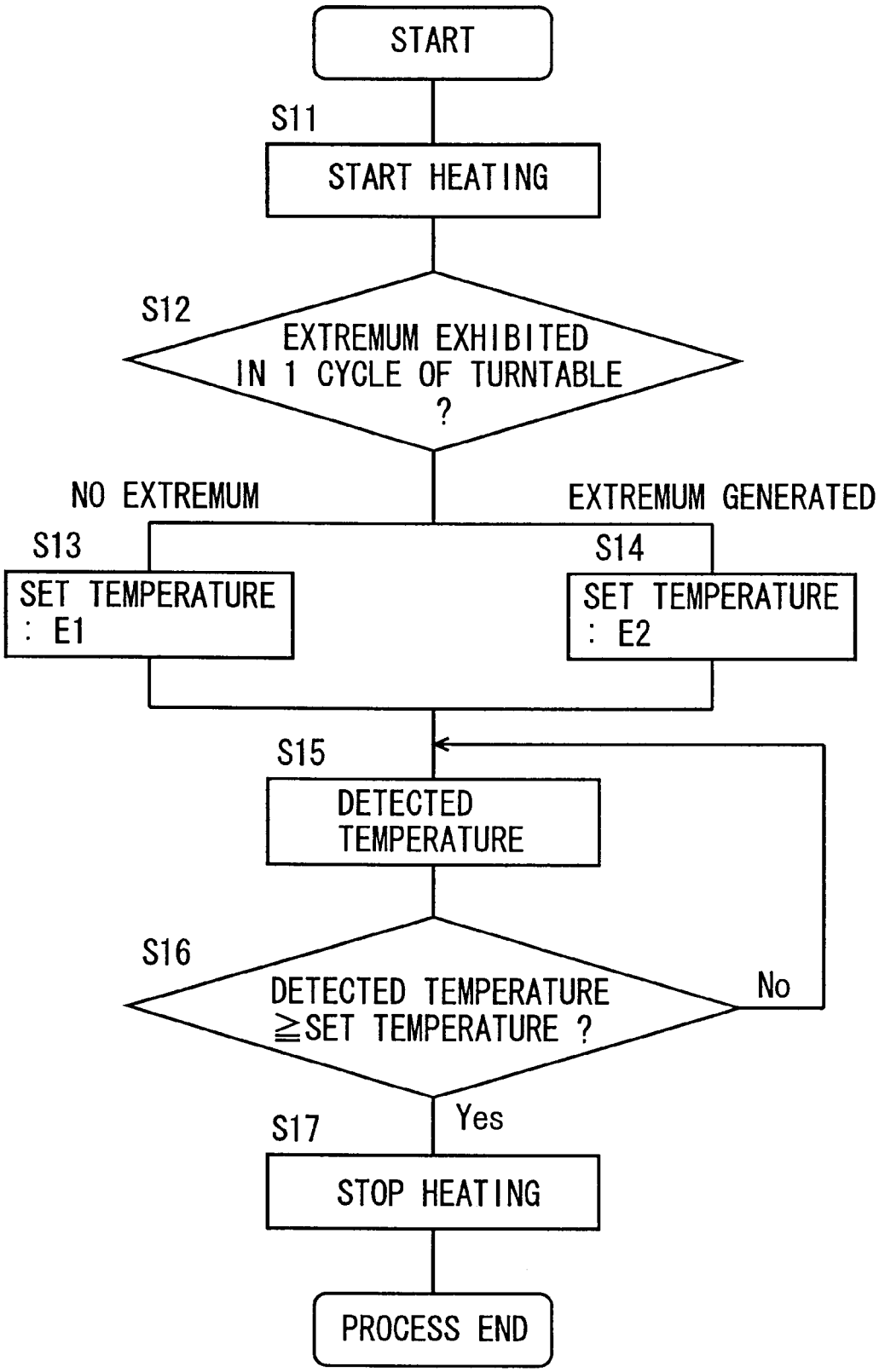
FIG. 24 represents the operation of the control unit when heating is effected by a cooking menu in the microwave oven of FIG. 1.

The present invention is not limited to the determination of whether foodstuff 31 is placed at the center of turntable 18 or not on the basis of whether there is an extremum in the detected temperature over a cycle T by control unit 90 as described in the process with reference to FIG. 24.

There is a particular site where the surface layer of foodstuff 31 within the sense field of infrared sensor 1 does not change even when foodstuff 31 is rotated as a result of rotation of turntable 18. In this case, control unit 90 determines whether foodstuff 31 is placed at that particular site on turntable 18 depending upon whether there is an extremum or not.

The present invention is configured to determine the mounted position of the foodstuff on the turntable according to the rate of change of infrared radiation in the vicinity of an extremum, if any, by the control unit on the basis of detecting the distance between foodstuff 31 and the center of turntable 18 according to the rate of change of the detected temperature in the vicinity of the extremum of the detected temperature, as described with reference to FIGS. 18 and 23.

According to the modification corresponding to the process of FIG. 24, control proceeds to S13 even when determination is made of an extremum at S12, provided that the rate of change in the detected temperature in the vicinity of the extremum is below a predetermined value. Therefore, the control unit is configured to determine that the foodstuff is located at the center of the turntable when the rate of change in the vicinity of the extremum is less than a predetermined value for infrared radiation.

According to the modification corresponding to the process of FIG. 24, control unit 90 adjusts the set temperature to any of E2–E4 according to the distance between foodstuff 31 and the center of turntable 18 by control unit 90. The control unit is configured to determine a different set temperature depending upon the distance between the determined mounted position of the foodstuff and the center of the turntable, to detect the temperature of the foodstuff according to the sensed amount of infrared radiation, and to drive the heat unit to heat the foodstuff until the determined foodstuff temperature arrives at the set temperature.

The relationship of set temperatures E1–E4 is not necessarily E1<E2<E3<E4 is established. There are cases where a lower temperature should be set as a function of distance from the center of the turntable depending upon the shape of the foodstuff. In this case, the relationship of E1>E2>E3>E4 is established.

Furthermore, the heating time can be set to any of F1~F4 (F1<F2<F3<F4) instead of setting the temperature to any of E1~E4 (E1<E2<E3<E4) according to the determination of whether foodstuff 31 is placed at the center of turntable 18, and if not, according to the distance between foodstuff 31 and the center of turntable 18. The control unit is configured to determine a different set time depending upon the distance between the determined mounted position of the foodstuff and the center of the turntable, and to drive the heat unit to heat the foodstuff for the set time. Each of heating time F1–F4 is the time from the start of the heating operation to the end of the heating operation. The set time corresponds to heating time F1–F4.

Set time F1–F4 is not necessarily longer as a function of distance from the center of the turntable, i.e., not necessarily F1<F2<F3<F4. There is the case where the heating time should be set shorter as a function of distance from the center of the turntable depending upon the shape of the foodstuff. In this case, the relationship of F1>F2>F3>F4 is established.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking appliance comprising:

a heating chamber to accommodate one or several foodstuff items, a heat unit, a turntable rotating at a predetermined cycle, and on which said one or several foodstuff items are mounted, an infrared sense unit sensing infrared radiation emitted from said one or several foodstuff items in said heating chamber, and a control unit determining a number of said foodstuff items according to a number of extrema for an amount of infrared radiation sensed over said predetermined cycle, and driving said heat unit according to said determined number of foodstuff items.

2. The cooking appliance according to claim 1, wherein said control unit determines a higher set temperature in proportion to a larger number of said determined number of foodstuff items, determines a temperature of said foodstuff it according to said amount of sensed infrared radiation, and drives said heat unit to heat said foodstuff items until said determined temperature of the foodstuff items reaches said set temperature.

3. The cooking appliance according to claim 1, wherein said control means determines a longer set time in proportion to a larger number of said determined number of foodstuff items, and drives said heat unit to heat said foodstuff items for said set time.

4. A cooking appliance comprising:

a heating chamber to accommodate a foodstuff, a heat unit, a turntable rotating at a predetermined cycle, and on which said foodstuff is mounted, an infrared sense unit sensing infrared radiation emitted from said foodstuff in heating chamber, and a control unit determining a mounted position of said foodstuff on said turntable depending upon whether an amount of infrared radiation sensed over said predetermined cycle exhibits an extremum, and driving said heat unit according to said determined mounted position of said foodstuff, wherein said control unit determines the mounted position of said foodstuff on said turntable according to a rate of change in the amount of infrared radiation in the vicinity of said extremum when said amount of infrared radiation exhibits said extremum.

5. The cooking appliance according to claim 4, wherein said control unit determines that said foodstuff is mounted at the center of said turntable when a rate of change in said amount of infrared radiation in the vicinity of the extremum is not more than a predetermined value.

6. The cooking appliance according to claim 5, wherein said control unit determines a different set temperature depending upon a distance between said determined mounted position of the foodstuff and the center of said turntable, determines a temperature of said foodstuff according to said amount of sensed infrared radiation, and drives said heat unit to heat said foodstuff until said determined temperature of the foodstuff arrives at said set temperature.

7. The cooking appliance according to claim 5, wherein said control unit determines a different set time depending upon a distance between said determined mounted position of the foodstuff and the center of said turntable, and drives said heat unit to heat said foodstuff for said set time.

8. The cooking appliance according to claim 4, wherein said control unit determines a different set temperature depending upon a distance between said determined mounted position of the foodstuff and the center of said turntable, determines a temperature of said foodstuff according to said amount of sensed infrared radiation, and drives said heat unit to heat said foodstuff until said determined temperature of the foodstuff arrives at said set temperature.

9. The cooking appliance according to claim 4, wherein said control unit determines a different set time depending upon a distance between said determined mounted position of the foodstuff and the center of said turntable, and drives said heat unit to heat said foodstuff for said set time.

* * * * *

UNITED STATES PATENT AND TRADEMARK OFFICE

CERTIFICATE OF CORRECTION

PATENT NO.: 6,121,596
DATED : September 19, 2000
INVENTOR(S): TAINO et al.

It is certified that an error appears in the above-identified patent and that said Letters Patent is hereby corrected as shown below:

On the title page of the patent in item [54] change the title "COOKING APPLIANCE THAN CAN DETECT..." to be --COOKING APPLIANCE THAT CAN DETECT...--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*